US005269077A

United States Patent [19]

Bruttini

[11] Patent Number: 5,269,077

[45] Date of Patent: Dec. 14, 1993

[54] CONTINUOUS FREEZE DRYING APPARATUS

[75] Inventor: Roberto Bruttini, Turin, Italy

[73] Assignee: Criofarma di Giorgio Bruttini & C. s.a.s., Turin, Italy

[21] Appl. No.: 982,075

[22] Filed: Nov. 24, 1992

[30] Foreign Application Priority Data

Dec. 11, 1991 [IT] Italy ..... T091A000959

[51] Int. Cl.[5] ..... F25C 1/00; F26B 13/00

[52] U.S. Cl. ..... 34/92; 62/353

[58] Field of Search ..... 34/5, 92; 62/353

[56] References Cited

U.S. PATENT DOCUMENTS 2,528,476 10/1950 Roos et al. ..... 34/92 X 3,218,731 11/1965 Stinchfield ..... 34/62

3,293,766 12/1966 Rogashi et al. ..... 34/5

3,740,860 6/1973 Smith, Jr. ..... 34/5

4,590,684 5/1986 Arsem ..... 34/92 X

*Primary Examiner*—William E. Wayner

*Attorney, Agent, or Firm*—James D. Hall

[57] ABSTRACT

Continuous freeze drying apparatus composed of a vessel whose internal chamber houses a cooled revolving cylinder on which a nebulizer sprays the material to be freeze dried.

A scraping blade, grazing the freezed material, removes it making it fall onto revolving holed planes heated by heating elements interposed between these revolving planes, in order to obtain a quick sublimation of the substance to be freeze dried.

7 Claims, 2 Drawing Sheets

CONTINUOUS FREEZE DRYING APPARATUS

BACKGROUND OF THE INVENTION

1. FIELD OF THE INVENTION

The present invention refers to a continuous freeze drying apparatus that can be employed in a particularly advantageous way when the treatment of great amounts of the same product is required.

2. BACKGROUND INFORMATION

As well known, freeze drying or lyophilization is a physical treatment to which perishable organic substances are subjected in order to ensure their long preservation.

It consists of a drying or dehydration process carried out under low temperature and vacuum conditions, where a diluent, usually water, is removed from the desired product through direct evaporation from the solid state (drying by sublimation).

U.S. Pat. No. 4,590,684 in the name of EDEN RESEARCH LABORATORIES, INC. describes a continuous freeze drying apparatus containing an inlet and a passageway for slurry material, an underlying holed plate including cooling passageways whose double function is cooling the plate and freezing the slurry passing through it, and a sublimation passageway that crosses the plate on the opposite surface to the inlet side.

A reduced pressure is kept inside the sublimation passageway and the pressure drop is kept within the plate area containing the slurry.

Next to the above-mentioned plate, in the sublimation passageway, a heating element checks the movement of the slurry cooled through the passageway increasing its sublimation upon entry.

This apparatus, however, has the disadvantage of providing a freeze dried product that is dimensionally dishomogeneous and morphologically uncontrolled, further requiring a subsequent intervention to make it powdery or granulated.

U.S. Pat. No. 3,740,860 in the name of SMITHERM INDUSTRIES, INC. describes a continuous freeze drying apparatus where a product is freezed onto a conveyor in a freezing compartment inside a vacuum vessel in which the pressure is high enough to keep volatiles from evolving from the freeze dried product.

This apparatus is provided for a continuous supply with a good amount, thus generating a compact output material and not a granulated one that can be more easily controlled and treated.

SUMMARY OF THE INVENTION

Purpose of the present invention is eliminating or reducing the above inconveniences or disadvantages, providing a continuous freeze drying apparatus suitable to automatically provide for a high production of the desired freeze dried powder, and at the same time to enable a continuous control of the powdery granule size; and suitable to avoid mechanical actions on the freeze dried product that could impair its morphological integrity, and to avoid, particularly for pharmaceutical freeze dried products, human interventions that could generate possible contaminations.

These and other purposes and advantages of the invention, as will appear from the following description, are obtained with a continous freeze drying apparatus comtaining:

a sealed vessel, said vessel comprising walls;

a controlled-pressure chamber contained inside said sealed vessel;

two condensation elements, each one of said two condensation elements being connected to said sealed vessel at a corresponding one of said walls;

a vacuum pump connected to said two condensation elements;

two check valves connected to said two condensation elements, each one of said two check valves being interposed between said vessel and said two condensation elements;

wherein said controlled-pressure chamber includes:

a revolving cylinder refrigerated at controlled temperature, said revolving cylinder having a lateral surface;

a scraping means, slightly spaced from said revolving cylinder and placed orthogonally to said lateral surface of said revolving cylinder;

a nebulizing means to spray a product to be freeze dried onto said lateral surface of said revolving cylinder, from which a freezed product is removed by said scraping means;

a plurality of overlapped revolving planes to collect and distribute a freezed material, each one of said plurality of revolving planes having a plurality of holes or gauged notches to make particles of a size less then the diameter of said holes or said notches, pass through them;

a plurality of heating elements interposed between each one of said revolving planes for the sublimation of a material to be freeze dried;

and wherein said continuous freeze drying apparatus further comprises a flow-regulating means and a removable means to collect a freeze dried material, both said flow-regulation means ans said removable means being located below one of the walls of said sealed vessel.

Further properties and advantages of the invention will better appear from the description of a preferred, but not exclusive, embodiment of the apparatus shown as a not limiting example in the enclosed drawings.

DESCRIPTION OF PREFERRED EMBODIMENTS

Figure 1:
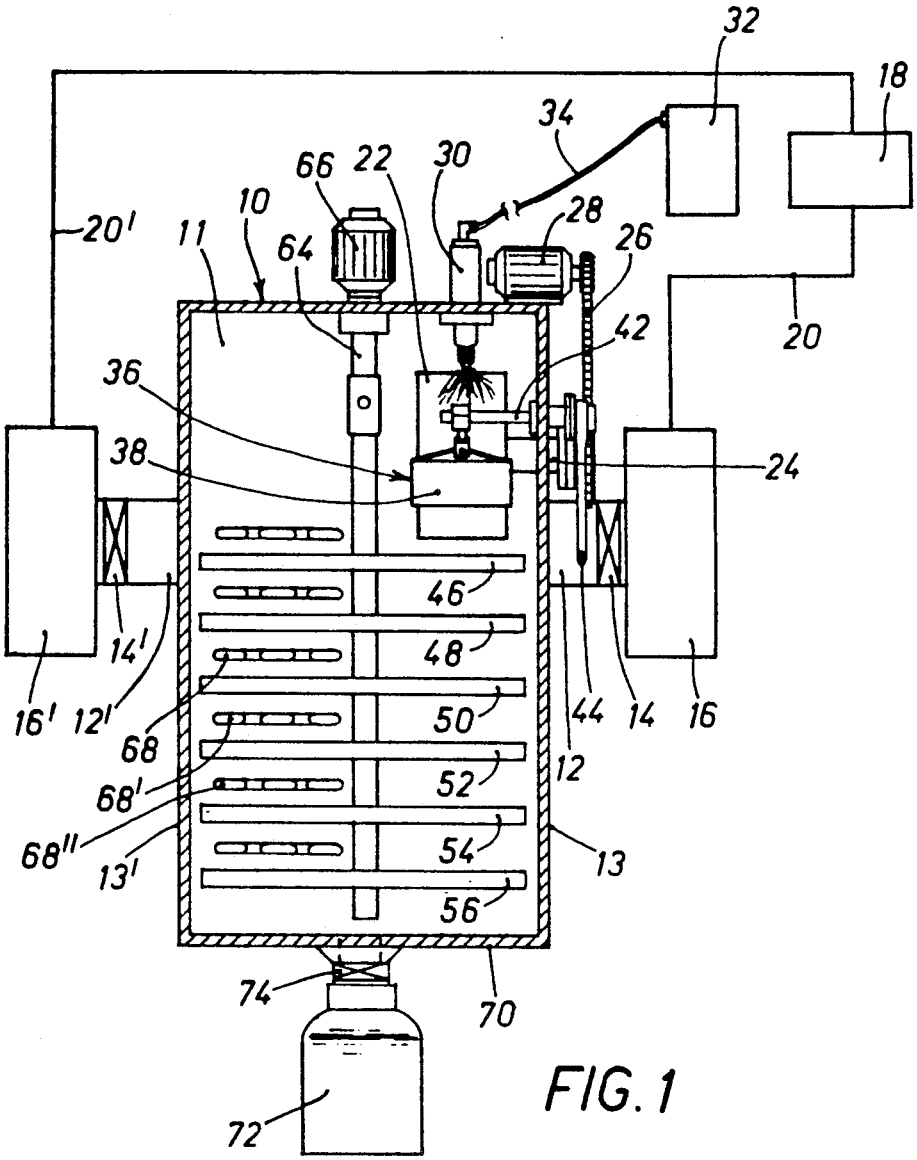
FIG. 1 is a front view of the continuous freeze drying apparatus according to the present invention.
Figure 2:
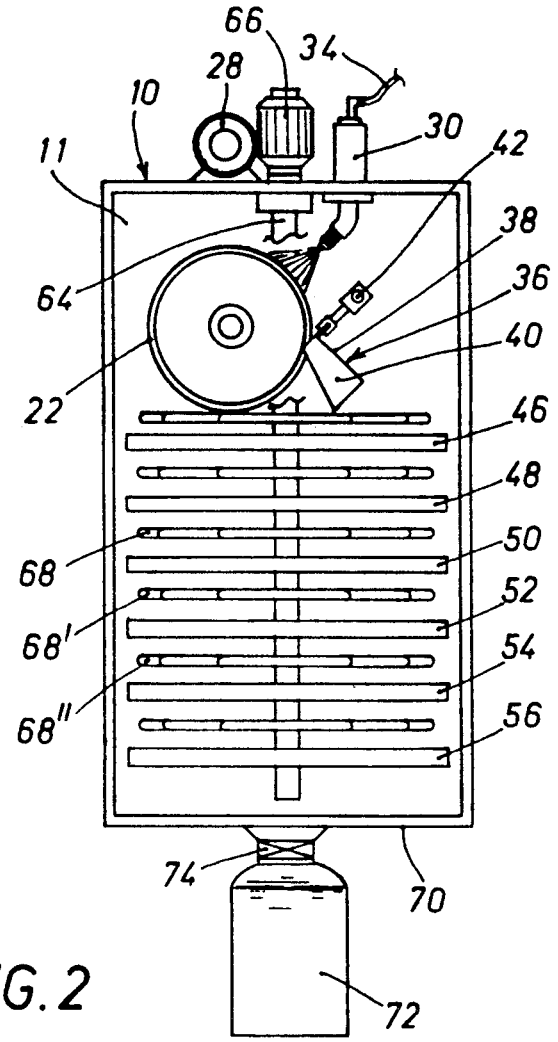
FIG. 2 is a side view of the continuous freeze drying apparatus according to the present invention.

With reference to FIGS. 1 and 2, the continuous freeze drying apparatus is composed of a sealed vessel 10 having an internal chamber 11, with a laterally-hinged access door, not shown in the Figures to have clearer drawings, substantially parallelepiped-shaped, connected, at corresponding lateral surfaces or walls 13, 13', to the ducts 12, 12' respectively supporting two chuck valves 14, 14' that intercept the thermal flow coming from the above-said chamber 11, and to two elements 16, 16' condensing the subliming solvent from the freezed product to be freeze dried, connected to a vacuum pump 18 through the ducts 20 and 20'.

Chamber 11 houses a revolving cylinder 22 keyed to a hollow shaft 24 (to make a cooling fluid pass through it) passing through the lateral surface 13.

A pinion, that is engaged to a chain 26 operated by an electric motor 28, is keyed to one end of said hollow shaft 24.

A nebulizing means 30 for the material to be freeze dried is placed next to said revolving cylinder 22 at a position that is substantially orthogonal with respect to an horizontal rotation axis and above the lateral surface, so that the nebulized material settles onto said lateral surface and is cooled when contacting it. A vessel 32 supplies the above-mentioned nebulizer 30 with material to be freeze dried through a connecting duct 34.

The removal of the material to be freeze dried, now freezed by the surface of the revolving cylinder 22, is carried out by a scraping means 35 that, grazing the freezed material, removes it and make it fall onto the underlying revolving planes.

The scraping means 36 is composed of a plan blade 38 with two tongues 40 (FIG. 2) placed at its side ends in order to convey the removed material towards the underlying planes.

On its upper side, said blade 38 is secured to an horizontal pin 42 (FIG. 1) protruding from the chamber 11 through its wall 13; this pin 42 has, at one of its ends, an operating lever 44 to move it to an angular position defined by the blade itself.

The material freezed on the revolving cylinder 22 and removed by the scraping blade 38, is collected onto a first revolving plane 46 and is afterwards distributed to other revolving planes 48, 50, 52, 54, 56 located one after the other below said first plane.

Figure 3:
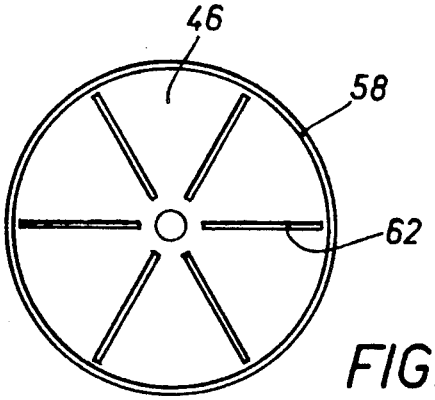
FIG. 3 is a plan view of a revolving plane according to an embodiment of the invention.
Figure 4:
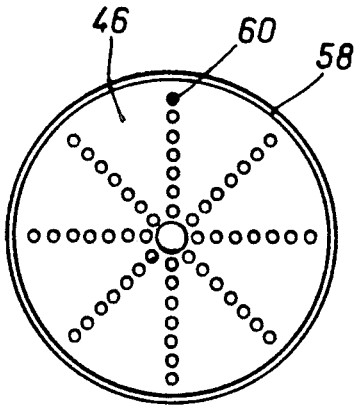
FIG. 4 is a plan view of a revolving plane according to another embodiment of the invention.

Each revolving plane 46÷56 shows a circular edge 58 (FIGS. 3 and 4) containing the material that can be freeze dried and a plurality of gauged holes 60 (FIG. 4) radially placed on the base of the plane itself, or a plurality of gauged through-notches 62, as shown in FIG. 3.

The revolving planes 46 +56 are centrally secured to a revolving shaft 64 rotatingly operated by an electric motor 66.

Both the gauged holes 60 and the gauged notches 62 present in the revolving planes 46÷56 carry out, at their slight impact with the freezed crystals of the material that can be freeze dried, a well-defined dimensional selection without subjecting them to such heavy mechanical actions as to impair the morphological structure of the material itself.

A plurality of heating elements, generally shown as 68, like armored resistors or serpentine ducts for thermal carrier fluids or radiating plate or lamp elements, are placed between the different revolving planes 46÷56 in order to heat the freeze dried material, subliming it.

The particular arrangement of the heating elements 68 provided inside the chamber 11, advantageously solves the problem of a quick sublimation of the treated material, greatly reducing working times and at the same time increasing production; in fact, on the same revolving plane, for example the one shown as 52 in FIG. 1, two heating elements shown as 68' and 68'' in FIG. 1 simultaneously operate, the first one, by convection, heating the area located above the revolving plane and the second one, by conduction, heating the base of the revolving plane.

With the above-described arrangement, a further drying step, known to the experts in the field as "secondary drying", has been advantageously removed, thus reducing production costs.

The freeze dried material that, falling from the revolving plane 56, settles onto the lower wall 70 of the vessel 10, is collected into a removable vessel 72 connected to a valve 74 that adjusts the amount of flow for the freeze dried material.

A preferred embodiment of the invention has been described, but obviously it is prone to numerous modifications or variations, like for example the number of heating elements and/or of revolving planes, always remaining within the scope of the inventive idea.

I claim:

1. A continous freeze drying apparatus comtaining:

a sealed vessel, said vessel comprising walls;

a controlled-pressure chamber contained inside said sealed vessel;

two condensation elements, each one of said two condensation elements being connected to said sealed vessel at a corresponding one of said walls;

a vacuum pump connected to said two condensation elements;

two check valves connected to said two condensation elements, each one of said two check valves being interposed between said vessel and said two condensation elements;

wherein said controlled-pressure chamber includes:

a revolving cylinder refrigerated at controlled temperature, said revolving cylinder having a lateral surface;

a scraping means, slightly spaced from said revolving cylinder and placed orthogonally to said lateral surface of said revolving cylinder;

a nebulizing means to spray a product to be freeze dried onto said lateral surface of said revolving cylinder, from which a freezed product is removed by said scraping means;

a plurality of overlapped revolving planes to collect and distribute a freezed material, each one of said plurality of revolving planes having a plurality of holes or gauged notches to make particles of a size less then the diameter of said holes or said notches, pass through them;

a plurality of heating elements interposed between each one of said revolving planes for the sublimation of a material to be freeze dried;

and wherein said continuous freeze drying apparatus further comprises a flow-regulating means and a removable means to collect a freeze dried material, both said flow-regulation means and said removable means being located below one of the walls of said sealed vessel.

2. A continuous freeze drying apparatus according to claim 1, wherein said revolving cylinder is keyed to a hollow shaft to make a cooling fluid pass through it and wherein, to one end of said shaft, a pinion is keyed that engages a chain operated by an electric motor.

3. A continuous freeze drying apparatus according to claim 1, wherein said nebulizing means is placed at a substantially orthogonal position with respect to an horizontal rotation axis of said revolving cylinder above said lateral surface.

4. A continuous freeze drying apparatus according to claim 1, wherein said scraping means is composed of a plan blade with two tongues supported at side ends of said plan blade, said blade being secured to an horizontal pin passing through a wall of said chamber at the end of which an operating lever is secured to define the exact position of the blade with respect to said revolving cylinder.

5. A continuous freeze drying apparatus according to claim 1, wherein said heating elements are composed of armored resistors.

6. A continuous freeze drying apparatus according to claim 1, wherein said heating elements are composed of serpentine ducts for thermal carrier fluids.

7. A continuous freeze drying apparatus according to claim 1, wherein said heating elements are composed of radiating plate or lamp elements.

* * * * *